United States Patent [19]

Kessinger

[11] 4,006,948

[45] Feb. 8, 1977

[54] FIRE HOSE CABINET

[76] Inventor: William B. Kessinger, Box 156, Beech Creek, Pa. 16822

[22] Filed: Jan. 23, 1976

[21] Appl. No.: 651,826

[52] U.S. Cl. ..... 312/242; 248/75; 137/355.16

[51] Int. Cl.[2] ..... A47B 67/02; B05B 75/36

[58] Field of Search ..... 312/100, 204, 242, 245; 248/90, 75, 89, 206 A; 285/281, 181; 137/355.16

[56] References Cited

UNITED STATES PATENTS

| | | | |
|---|---|---|---|
| 1,375,822 | 4/1921 | Borgeson | 285/281 |
| 3,329,381 | 4/1967 | Moore | 248/89 |
| 3,521,936 | 7/1970 | Coker, Jr. | 312/245 |
| 3,752,055 | 11/1973 | Shuler | 248/206 A |
| 3,776,262 | 12/1973 | Fritsch | 137/355.16 |
| 3,918,782 | 11/1975 | Allmand | 248/90 X |

*Primary Examiner*—Casmir A. Nunberg
*Attorney, Agent, or Firm*—Thomas Hooker

[57] ABSTRACT

A fire hose cabinet including a cabinet body with a hose-receiving spool mounted on a rear wall of the body. A water line extends to an on-off valve located within the spool with the outlet of the valve running through a swivel to an elbow on the outside of the spool. A fire hose is attached to the elbow and wrapped around the spool. A door closing the open side of the cabinet may be readily opened to provide access to the fire hose when needed.

2 Claims, 4 Drawing Figures

FIRE HOSE CABINET

Figure 1:
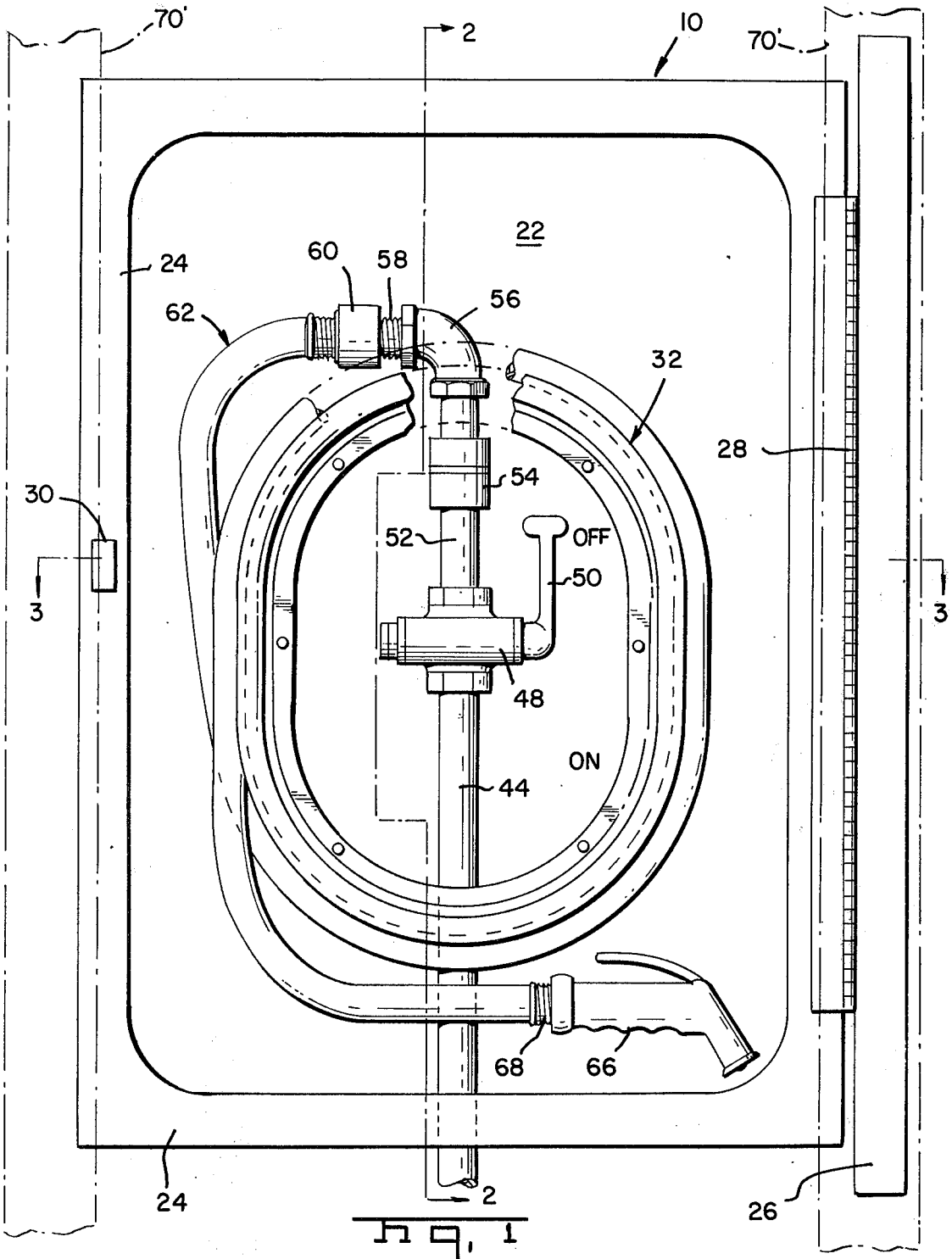

The invention relates to an improved fire hose cabinet of the type intended to be mounted on or in a wall with a length of fire hose wound on a spool within the cabinet so that it is readily available when needed. A door closes the cabinet when the hose is not needed and may be decorated to blend with the surrounding decor.

The cabinet is provided with an on-off master control valve located within the center of the hose receiving spool to permit ready pressurizing of the hose by turning the valve on. The sides of the spool diverge away from each other outwardly of the rear wall of the cabinet to facilitate wrapping loops of the hose around the spool. The end of the hose is attached to the valve through a 90° elbow and swivel connection so that when the door is open and the hose is removed from the spool it may be led to either side of the cabinet as desired. The specialized spool facilitates easy and rapid removal of the hose from the cabinet in the case of fire.

Various types of hose-receiving spools are well known in the Prior Art. See U.S. Pat. Nos. 1,284,022, 1,599,581, 3,329,381 and 3,776,262.

Other objects and features of the invention will become apparent as the description proceeds, especially when taken in conjunction with the accompanying drawings illustrating the invention, of which there are two sheets.

IN THE DRAWINGS

Figure 2:
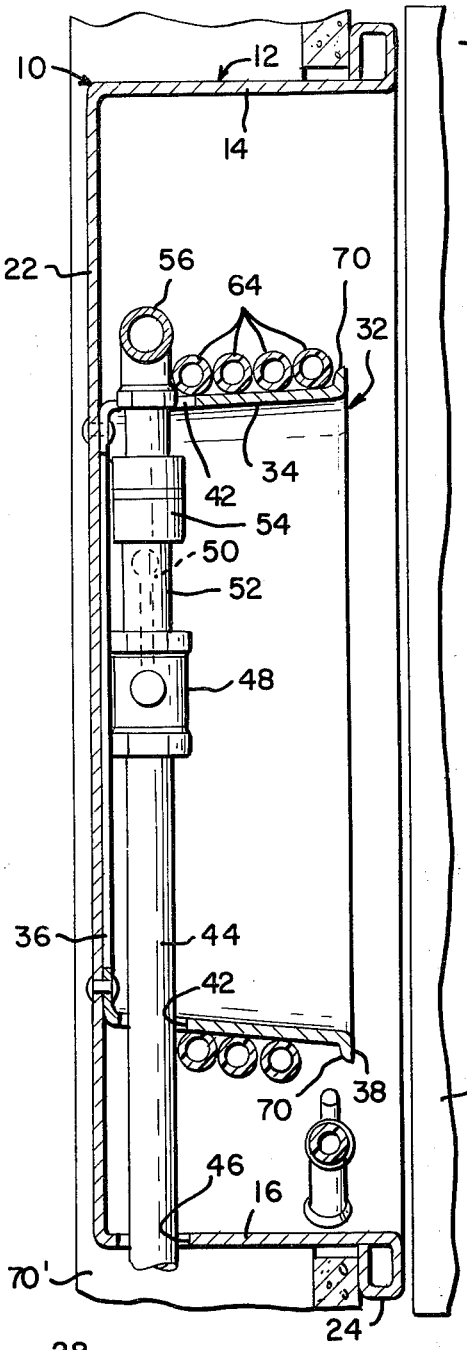
Figure 4:
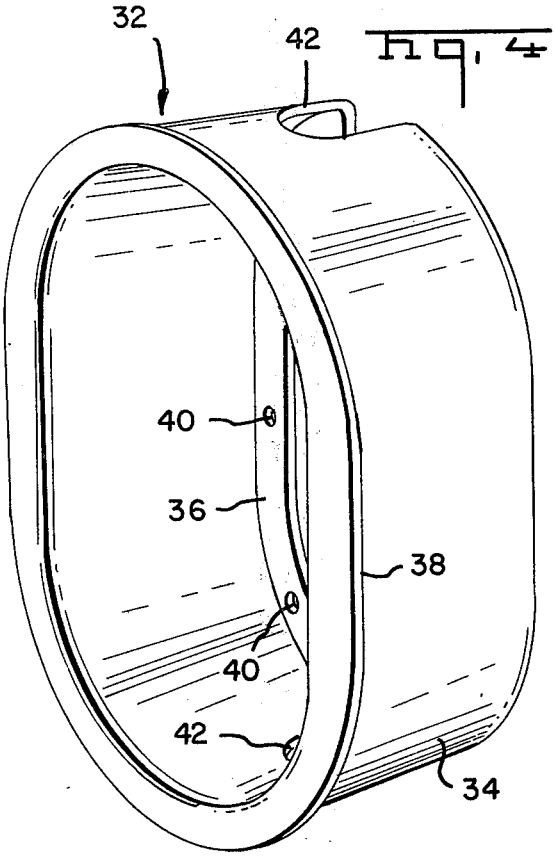
Figure 7:
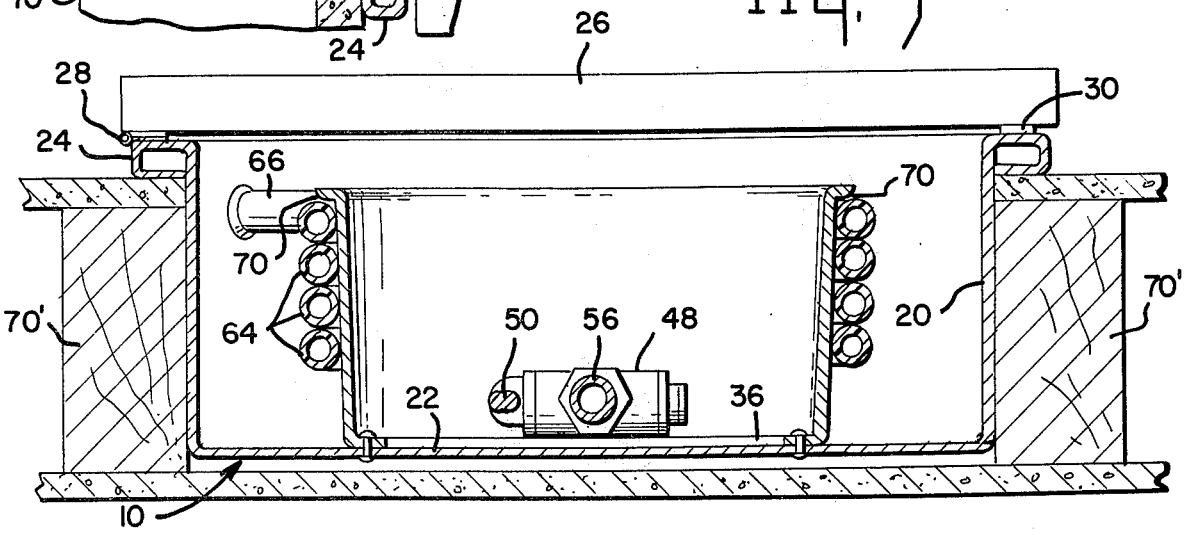

FIG. 1 is a front partially broken away view of a fire hose cabinet according to the invention showing the cabinet mounted in a wall between studs with the door half open;

FIGS. 2 and 3 are sectional views taken along lines 2—2 and 3—3 respectively of FIG. 1; and FIG. 4 is a prospective view of a spool as used in the cabinet of FIGS. 1 through 3.

Fire hose cabinet 10 includes a rectangular cabinet body 12 having top and bottom walls 14 and 16, side walls 18 and 20 and a rear wall 22 joining the top, bottom and side walls. Mounting lip 24 extends around the edges of the top, bottom and side walls away from the rear wall to facilitate flush mounting of the cabinet in an opening within a wall in a manner to be described. Door 26 is secured to lip 24 adjacent side wall 18 by piano hinge 28 so that the door may be opened and closed as illustrated. In FIG. 1 the door is half open. A magnetic door catch 30 is secured to the lip adjacent side wall 20 permitting immediate opening of the door and access to the fire hose in the case of emergency. The cabinet body 12 may be formed of metal, plastic or other suitable materials, as desired.

A hose receiving spool 32 illustrated in FIG. 4, includes a rounded wrapping portion 34 with an inwardly directed mounting flange 36 extending from one edge of the portions 34 and an outwardly directed hose-retaining flange 38 extending from the opposite edge of the wrapping portion. The spool is secured to rear wall 22 of body 12 by bolts, rivets, or like fasteners extending through holes 40 in mounting flange 36 and similar holes formed in the rear wall 22. See FIG. 2. Pipe-receiving cut outs 42 are formed in the wrapping portion at the top and bottom of the elongated spool. As illustrated in FIGS. 2 and 3, the sides of the wrapping portion diverge from each other away from wall 22 to facilitate wrapping of fire hose around the spool.

Water line 44 extends into the interior of body 12 through a suitable knock-out opening 46, formed in bottom wall 16. Obviously the opening may be formed in another wall if desired. From the knock out opening the pipe extends through the lower cut out 42 into the interior of spool 32 to an on-off valve 48 having a control level 50. The valve 48 is secured to the cabinet rear wall 22. Outlet pipe 52 extends from valve 48 past a pipe swivel 54 to 90° elbow 56 which projects through the upper cut out 42 in the spool above the wrapping portion 34. A threaded nipple 58 is attached to the free end of the elbow.

End 60 of fire hose 62 is threadably attached to the nipple 58 and the elbow is rotated against the rear wall 22 so that the length of the hose 62 may be then wound about the elongated rounded wrapping portion 34 of the spool 32. The divergent sides of the wrapping portion retain the hose loops 64 in place during and following wrapping as illustrated in FIGS. 2 and 3. While the drawings illustrate only one row of loops being wound of the spool, obviously a second or further row of loops may be wound on the spool if desired. A manually actuable nozzle 66 is received on free end 68 of hose 62 and either hangs from the spool or lies on the bottom wall 16 of the cabinet. In either event, the nozzle is readily available in case of an emergency.

The fire hose cabinet 10 may either be mounted in an opening in a wall between adjacent studs 70 as illustrated with lip 24 flush against the wall, or, alternatively, may be mounted on the surface of a wall so that cabinet rear wall 22 is flush with the exterior surface of the wall. In the latter case, the water line would extend into the interior of the cabinet through a knock out openning in the rear wall. The exterior surface of the door 26 may be provided with a decorative picture, mirror, bulletin board panel or other device tending to blend the door with the immediate surroundings.

In the case of a fire, the fire house cabinet 10 is easily opened by pulling the door from the closed position of FIG. 3 to overcome the magnetic latch 30, thus exposing valve 48 and the fire hose on the spool and enabling the user to unwind the hose from the spool. The outwardly directed hose retaining lip 38 extends away from the wrapping portion 34 a distance approximately one half the diameter of the hose 64 or less so that the hose is easily removed by slightly loosening the loops 64 and pulling them over the lip. Removal of the hose is further facilitated by the rounded inner loop edge 70 which facilitates sliding of the loops over the flange and out of the cabinet.

The hose once removed from the cabinet may be pulled out in the direction as desired without kinking due to the swivel connection 54 in the outlet from the valve 50. The swivel allows rotation of the elbow either to the right or left to prevent kinking. When the hose is removed the valve 50 is turned from the off to the on position, thus pressurizing the hose and permitting a spray of water to be directed on the fire by opening nozzle 66. The hose is not normally pressurized while wound on the spool in order to prevent pressure deterioration and possible rupture.

While I have illustrated and described preferred embodiments of my invention, it is understood that this is capable of modification, and I therefore do not wish to be limited to the precise details set forth, but desire to avail myself of such changes and alterations as fall within the purview of the following claims.

What I claim as my invention is:

1. A cabinet for mounting a fire hose or the like comprising a cabinet body having side walls and a rear wall; a door attached to a side wall by a hinge for closing the front of the cabinet; a hose-receiving spool mounted on the rear wall within the body and including an interior opening, a rounded wrapping portion having a smooth exterior surface extending from the rear wall toward the door, opposed sections of the exterior surface diverging from each other away from the rear wall, inwardly directed mounting means on the edge of the wrapping portion adjacent the rear wall and secured thereto, and an outwardly directed hose-retaining flange on the edge of the wrapping portion away from the rear wall; an on-off valve mounted within the interior opening adapted to be connected to a water line; an outlet water line extending from said valve through an opening in the spool to an elbow located outwardly of the exterior surface of the wrapping portion; a swivel in the outlet line between the valve and elbow; and a hose, one end of the hose being secured to the elbow, a nozzle secured to the other end of the hose, hose loops wrapped around the exterior surface of the wrapping portion, said flange extending a distance from exterior surface equal to approximately one half the diameter of the hose and including a rounded edge facing the rear wall to facilitate rapid removal of the hose from the spool.

2. A cabinet as in claim 1 wherein said wrapping portion includes a continuous exterior surface extending around the spool with an opening formed there through adjacent the rear wall to receive said outlet line and wherein said flange extends completely around the free edge of the wrapping portion.

* * * * *